US008636897B2

(12) United States Patent
Chakrabary et al.

(10) Patent No.: US 8,636,897 B2
(45) Date of Patent: Jan. 28, 2014

(54) REDUCING FOULANT CARRY-OVER OR BUILD UP IN A PARAFFINIC FROTH TREATMENT PROCESS

(75) Inventors: Tapantosh Chakrabary, Calgary (CA); Mohsen Yeganeh, Hillsborough, NJ (US); Limin Song, West Windsor, NJ (US); Ken Sury, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 867 days.

(21) Appl. No.: 12/663,452

(22) PCT Filed: Jun. 18, 2008

(86) PCT No.: PCT/US2008/007578

§ 371 (c)(1),
(2), (4) Date: May 25, 2010

(87) PCT Pub. No.: WO2009/017543

PCT Pub. Date: Feb. 5, 2009

(65) Prior Publication Data

US 2010/0243535 A1 Sep. 30, 2010

(30) Foreign Application Priority Data

Jul. 31, 2007 (CA) ..... 2595336

(51) Int. Cl.
*C10G 75/00* (2006.01)
*C10G 1/04* (2006.01)

(52) U.S. Cl.
USPC ..... 208/390; 208/47; 208/48 R

(58) Field of Classification Search
USPC ..... 208/390, 47, 48 R; 134/6, 22.1, 22.11, 134/23, 32, 40
See application file for complete search history.

(56) References Cited

U.S. PATENT DOCUMENTS

| | | | |
|---|---|---|---|
| 4,676,889 | A | 6/1987 | Hsieh et al. |
| 5,143,598 | A | 9/1992 | Graham et al. |
| 5,236,577 | A | 8/1993 | Tipman et al. |
| 5,274,572 | A | 12/1993 | O'Neill et al. |

(Continued)

FOREIGN PATENT DOCUMENTS

| | | |
|---|---|---|
| CA | 940853 | 1/1974 |
| CA | 2075108 | 1/1994 |

(Continued)

OTHER PUBLICATIONS

Clamentz, David M. "Interaction of Petroleum Heavy Ends with Montmorillonite", Clays and Clay Minerals, vol. 24, pp. 312-319, 1976 (no month).*

(Continued)

*Primary Examiner* — Renee E Robinson
(74) *Attorney, Agent, or Firm* — ExxonMobil Upstream Research Company-Law Department

(57) ABSTRACT

A use of a foulant collector in a vessel or conduit in a paraffinic froth treatment (PFT) process. The foulant comprises asphaltenes. The foulant collectors are purposed to reduce build-up in the vessel or conduit and/or to reduce downstream foulant carry-over in the process. The surface of the foulant collectors may have an average water contact angle of less than 90 degrees. Additionally, together with such foulant collectors, a fluorocarbon polymer may be used as a surface of a vessel or conduit in the PFT process, for reducing fouling.

29 Claims, 11 Drawing Sheets

(56) References Cited

U.S. PATENT DOCUMENTS

| | | | |
|---|---|---|---|
| 5,781,430 | A | 7/1998 | Tsai |
| 5,876,592 | A | 3/1999 | Tipman et al. |
| 5,913,022 | A | 6/1999 | Tinaztepe et al. |
| 5,920,718 | A | 7/1999 | Uczekaj et al. |
| 5,968,349 | A | 10/1999 | Duyvesteyn et al. |
| 6,007,709 | A | 12/1999 | Duyvesteyn et al. |
| 6,028,819 | A | 2/2000 | Mullarkey et al. |
| 6,074,558 | A | 6/2000 | Duyvesteyn et al. |
| 6,182,014 | B1 | 1/2001 | Kenyon et al. |
| 6,191,787 | B1 | 2/2001 | Lu et al. |
| 6,195,092 | B1 | 2/2001 | Dhond et al. |
| 6,214,213 | B1 | 4/2001 | Tipman et al. |
| 6,323,679 | B1 | 11/2001 | Robertson et al. |
| 6,358,403 | B1 | 3/2002 | Brown et al. |
| 6,358,404 | B1 | 3/2002 | Brown et al. |
| 6,374,252 | B1 | 4/2002 | Althoff et al. |
| 6,401,081 | B1 | 6/2002 | Montgomery et al. |
| 6,411,922 | B1 | 6/2002 | Clark et al. |
| 6,498,988 | B1 | 12/2002 | Robert et al. |
| 6,678,642 | B1 | 1/2004 | Budge |
| 6,712,215 | B2 | 3/2004 | Scheybeler |
| 6,731,994 | B2 | 5/2004 | Heching et al. |
| 6,731,998 | B2 | 5/2004 | Walser et al. |
| 6,800,116 | B2 | 10/2004 | Stevens et al. |
| 6,829,570 | B1 | 12/2004 | Thambynayagam et al. |
| 6,910,001 | B2 | 6/2005 | Hammersley et al. |
| 6,934,931 | B2 | 8/2005 | Plummer et al. |
| 6,980,935 | B2 | 12/2005 | Lu et al. |
| 6,980,940 | B1 | 12/2005 | Gurpinar et al. |
| 6,996,803 | B2 | 2/2006 | Sakamoto et al. |
| 7,067,811 | B2 | 6/2006 | Long et al. |
| 7,141,162 | B2 | 11/2006 | Garner et al. |
| 7,261,810 | B2 | 8/2007 | Argo et al. |
| 7,282,136 | B2 | 10/2007 | Howdeshell |
| 7,296,274 | B2 | 11/2007 | Cohen et al. |
| 7,376,472 | B2 | 5/2008 | Wojsznis et al. |
| 7,451,066 | B2 | 11/2008 | Edwards et al. |
| 7,478,024 | B2 | 1/2009 | Gurpinar et al. |
| 7,499,841 | B2 | 3/2009 | Hoffman |
| 7,516,446 | B2 | 4/2009 | Choi et al. |
| 7,546,578 | B2 | 6/2009 | Yang |
| 2003/0017349 | A1 | 1/2003 | Brown et al. |
| 2003/0018490 | A1 | 1/2003 | Magers et al. |
| 2003/0125818 | A1 | 7/2003 | Johnson |
| 2003/0139907 | A1 | 7/2003 | McCarthy |
| 2004/0054564 | A1 | 3/2004 | Fonseca et al. |
| 2004/0111428 | A1 | 6/2004 | Rajan et al. |
| 2005/0016610 | A1 | 1/2005 | Lahijani |
| 2005/0027559 | A1 | 2/2005 | Rajan et al. |
| 2005/0150844 | A1* | 7/2005 | Hyndman et al. ..... 210/750 |
| 2005/0229992 | A1* | 10/2005 | McKeen et al. ..... 138/141 |
| 2005/0263437 | A1 | 12/2005 | Howdeshell |
| 2006/0014296 | A1 | 1/2006 | Brons et al. |
| 2006/0076274 | A1 | 4/2006 | Duyvesteyn et al. |
| 2006/0111903 | A1 | 5/2006 | Kemmochi et al. |
| 2006/0113218 | A1 | 6/2006 | Hart et al. |
| 2006/0138036 | A1 | 6/2006 | Garner et al. |
| 2006/0138055 | A1 | 6/2006 | Garner et al. |
| 2006/0151397 | A1* | 7/2006 | Wright et al. ..... 210/704 |
| 2006/0196812 | A1 | 9/2006 | Beetge et al. |
| 2006/0247481 | A1 | 11/2006 | Kulprathipanja et al. |
| 2006/0249439 | A1 | 11/2006 | Garner et al. |
| 2006/0260980 | A1 | 11/2006 | Yeung |
| 2006/0282243 | A1 | 12/2006 | Childs et al. |
| 2007/0144631 | A1 | 6/2007 | Clavenna et al. |
| 2007/0156377 | A1 | 7/2007 | Gurpinar et al. |
| 2007/0168057 | A1 | 7/2007 | Blevins et al. |
| 2007/0168741 | A1 | 7/2007 | Chadha et al. |
| 2008/0208552 | A1 | 8/2008 | Kumar et al. |
| 2008/0288226 | A1 | 11/2008 | Gurpinar et al. |

FOREIGN PATENT DOCUMENTS

| | | | |
|---|---|---|---|
| CA | 2200899 | A1 | 9/1998 |
| CA | 2232929 | C | 5/2004 |
| CA | 2505411 | | 7/2004 |
| CA | 2425840 | A1 | 10/2004 |
| CA | 2435113 | | 1/2005 |
| CA | 2493677 | | 6/2005 |
| CA | 2455011 | | 7/2005 |
| CA | 2353109 | C | 12/2005 |
| CA | 2520943 | A1 | 4/2006 |
| CA | 2490734 | | 6/2006 |
| CA | 2502329 | | 9/2006 |
| CA | 2521248 | A1 | 3/2007 |
| CA | 2587166 | C | 10/2008 |
| CA | 2613873 | C | 10/2008 |
| CA | 2614669 | C | 12/2008 |
| CA | 2592725 | C | 4/2009 |
| WO | WO 99/33936 | | 7/1999 |

OTHER PUBLICATIONS

Wu, S. et al., "Experimental Methods for Contact Angles and Interfacial Tensions", *Polymer Interface and Adhesion*, 1982, pp. 257-260, Chapter 8, New York.

* cited by examiner

Before

After

Before

After

Before

After

Before

After

Before

After

Before

After

Before

After

Before

After

Before

After

REDUCING FOULANT CARRY-OVER OR BUILD UP IN A PARAFFINIC FROTH TREATMENT PROCESS

CROSS REFERENCE TO RELATED APPLICATIONS

This application is the National Stage of International Application No. PCT/US2008/007578, filed 18 Jun. 2008, which claims priority from Canadian Patent Application number 2,595,336 which was filed on 31 Jul. 2007, which is incorporated herein by reference.

FIELD OF THE INVENTION

The present invention relates generally to reducing foulant carry-over or build-up in a paraffinic froth treatment process.

BACKGROUND OF THE INVENTION

In the field of bitumen extraction from mined oil sands, solvent froth treatment may be used. Generally, oil sands are mined, bitumen is extracted from the sands using water, and bitumen is separated as a froth comprising bitumen, water, solids and air. In certain froth treatment processes, naphtha is used as the solvent to dilute the froth before separating the product bitumen by centrifugation. In other cases, paraffinic froth treatment (PFT) is used where a paraffinic solvent, for instance a mixture of iso-pentane and n-pentane, is used to dilute the froth before separating the product bitumen by gravity. Where a paraffinic solvent is used, a portion of the asphaltenes in the bitumen is also rejected by design in the PFT process thus achieving solid and water levels that are lower than those in the naphtha-based froth treatment (NFT) process. A PFT process typically employs at least three units: a froth separation unit (FSU), a solvent recovery unit (SRU) and a tailings solvent recovery unit (TSRU). An example of a PFT process is described below. During a PFT process, foulant, which comprises asphaltenes, may form and build on one or more surfaces of the FSU or other vessel or conduit used in the PFT process. The foulant may build up to a thickness at which it interferes with the normal operation of the process. The vessel or conduit should then be cleaned. Further, foulant may be carried over to downstream vessels, equipment, or conduits in the PFT process, for instance downstream of the FSU. Reducing foulant build-up in the vessel or conduit and/or reducing carry-over from the vessel or conduit is desirable.

SUMMARY OF THE INVENTION

Generally, the present invention provides a use of a foulant collector in a vessel or conduit in a paraffinic froth treatment (PFT) process. The foulant comprises asphaltenes. The foulant collectors are purposed to reduce build-up in the vessel or conduit and/or to reduce downstream foulant carry-over in the process. The surface of the foulant collectors may have an average water contact angle of less than 90 degrees. The foulant collectors can collect foulant preferentially over the vessel or conduit wall. Additionally, together with such foulant collectors, a fluorocarbon polymer may be used as a surface of a vessel or conduit in the PFT process, for reducing fouling.

In one aspect, the present invention provides a use, for collecting foulant to reduce build-up or downstream foulant carry-over, of a foulant collector comprising a foulant collecting surface in a vessel or conduit used in a paraffinic froth treatment (PFT) process, the foulant comprising asphaltenes, wherein the foulant collecting surface has an average water contact angle of less than 90 degrees. In certain embodiments, the following features may be present.

The foulant collecting surface may have an area equal to or greater than an area of a portion of the vessel or conduit which collects foulant. The foulant collecting surface may have an area at least 30 percent greater than the area of the portion of the vessel or conduit which collects foulant. The foulant collecting surface may collect foulant preferentially over the vessel or conduit due to higher surface energy and optionally higher surface area.

The foulant collector may be used to collect foulant for subsequent dislodgement therefrom by intermittent in situ dislodgement. An advantage of dislodging the foulant in situ is that operation of the vessel or conduit may continue without interruption, or with reduced interruption, thereby reducing downtime.

In one embodiment, dislodgement external to the vessel or conduit is used where the vessel or conduit is shut down for periodic maintenance.

In one embodiment, a combination of in situ and external dislodgement may be employed.

Downtime may also be reduced due to reduced downstream foulant carry-over.

The foulant collecting surface may have a standard deviation of water contact angles divided by an average water contact angle of greater than 0.1. The foulant collecting surface may have impurities having an average water contact angle of greater than 90 degrees in an amount greater than 1000 parts per million by weight (ppmw). The foulant collecting surface may comprise or may be carbon steel. The foulant collecting surface may comprise a metal, a ceramic, a polymer, or a composite. The foulant collecting surface may comprise cement, rubber, Teflon®, fibre reinforced plastic or diamond-like carbon.

Foulant collectors may be used together with a fluorocarbon polymer as a surface of a vessel or conduit in a paraffinic froth treatment (PFT) process, the fluorocarbon polymer surface being for reducing fouling, the foulant comprising asphaltenes, wherein the fluorocarbon polymer surface has: an average water contact angle of greater than 90 degrees; a standard deviation of water contact angles divided by the average water contact angle of less than 0.1; and impurities of less than 1000 ppmw. In one embodiment, the average water contact angle of the fluorocarbon polymer surface is greater than 110 degrees; the standard deviation of water contact angles of the fluorocarbon polymer surface divided by the average water contact angle of the surface is less than 0.05; less than 100 ppmw impurities are present in the fluorocarbon polymer surface; and the fluorocarbon polymer comprises a polytetrafluoroethylene (PTFE)-based polymer, wherein a PTFE-based polymer is a homopolymer of TFE (tetrafluoroethylene) or a copolymer of TFE with one or more comonomers comprising at least one ethylene-type unsaturation, wherein comonomer content is less than 1 percent by weight.

In one aspect, the present invention provides a process for collecting foulant in a vessel or conduit used in a paraffinic froth treatment (PFT) process to reduce build-up or downstream foulant carry-over, the foulant comprising asphaltenes, the process comprising: disposing a foulant collector comprising a foulant collecting surface in the vessel or conduit to collect foulant; and removing at least a portion of collected foulant from the vessel or conduit; wherein the foulant collecting surface has an average water contact angle of less than 90 degrees. In certain embodiments, the following features may be present.

The removing step may comprise dislodging at least a portion of collected foulant from the foulant collecting surface and then removing at least a portion of the removed foulant from the vessel or conduit. The removing step may comprise removing the foulant collector from the vessel or conduit and then optionally dislodging at least a portion of collected foulant from the foulant collecting surface. The dislodging step may comprise scraping foulant from the foulant collecting surface. The dislodging step may comprise application of a mechanical force to the foulant collector. The mechanical force may comprise applying an impact force to the foulant collector or vibrating the foulant collector. The vibrating may be effected using a vibration system external to the vessel or conduit. The vibration system may comprise one or more vibrators, the vibrators being pneumatic, electromagnetic dynamic, or electro-piezo shakers. The vibration on the foulant collector surface may have an amplitude of 1 g or higher and an impact frequency of 1 Hz or higher. The vibration may be actuated by a vibration actuator that emits sound waves to the foulant collector. The vibration may be effected at predetermined intervals of time, or upon command.

The vessel or conduit may be a froth separation unit (FSU), wherein the foulant collectors are disposed in a hydrocarbon leg of the FSU, the process further comprising: prior to the step of removing at least a portion of collected foulant from the FSU, lowering the foulant collector(s) into a water leg of the FSU; wherein the step of removing at least a portion of collected foulant from the FSU comprises removing the at least a portion of collected foulant together with tailings from the FSU.

The foulant may comprise water, paraffinic solvent, inorganics, and non-volatile hydrocarbons comprising asphaltenes. The foulant may comprise 5-80 percent water and paraffinic solvent, 1-80 percent inorganics, 1-90 percent non-volatile hydrocarbons comprising asphaltenes, all by weight. The foulant may comprise about 46-50 percent water and paraffinic solvent, about 24-46 percent inorganics, and about 14-26 percent non-volatile hydrocarbons comprising asphaltenes, all by weight. The foulant may comprise between 7 and 40 percent asphaltenes, by weight. The inorganics may comprise quartz, alumino-silicates, carbonates, $Fe_xS_y$, where x is from 1 to 2 and y is from 1 to 3, and titanium-rich minerals. A major amount by number of the inorganics may be present in particulates of less than 1 μm in size.

The combination of the surface energy characteristics of the foulant collector surface, as defined by water contact angle, and the surface area may enable or assist the preferential foulant deposition on the foulant collector rather than on the surface of the vessel or conduit.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

Figure 1:
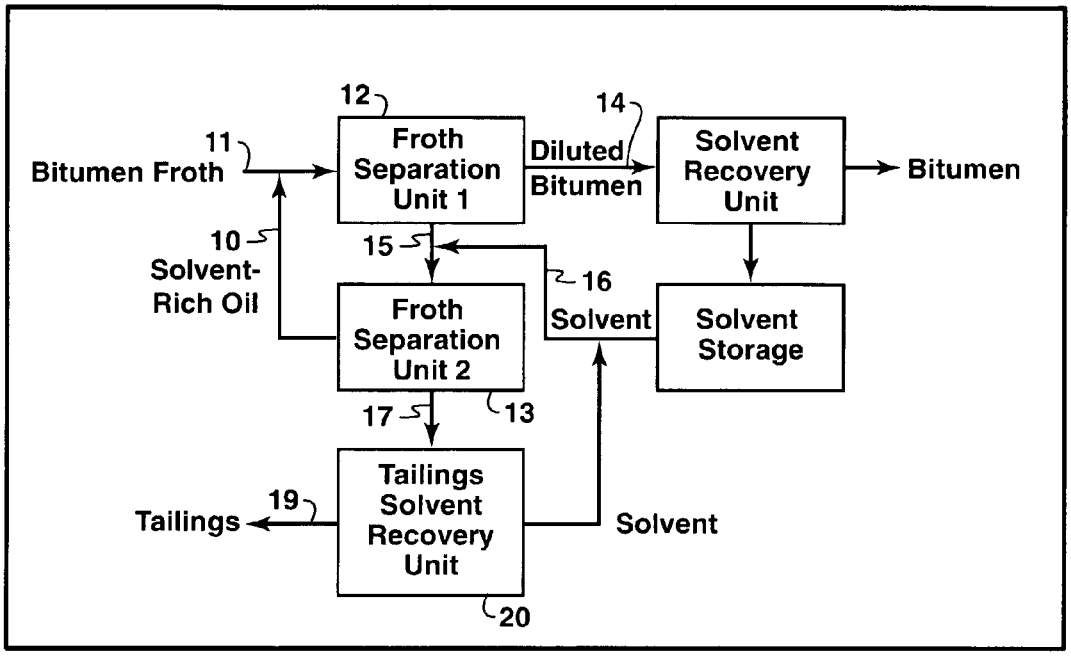
FIG. 1 is a schematic of a PFT process.

An example of a PFT process will now be described with reference to FIG. 1. Solvent 10 is mixed with the bitumen froth 11 counter-currently in the FSU, or as shown in FIG. 1, in two stages (FSU-1 (12) and FSU-2 (13)). In FSU-1 (12), the froth 11 is mixed with a solvent-rich oil stream 10 from FSU-2 (13). The temperature of FSU-1 is maintained at about 60 to 80° C., or about 70° C. and the target solvent to bitumen ratio is about 1.4:1 to 2.2:1 by weight or about 1.6:1 by weight. The overflow from FSU-1 is the diluted bitumen product 14 and the bottom stream 15 from FSU-1 is the tailings comprising water, solids (inorganics), asphaltenes, and some residual bitumen. The residual bitumen from this bottom stream 15 is further extracted in FSU-2 by contacting it with fresh solvent 16, for example in a 25:1 to 30:1 by weight solvent to bitumen ratio at, for instance, 80 to 100° C., or about 90° C. The solvent-rich overflow 10 from FSU-2 is mixed with the fresh froth feed 11 as mentioned above. The bottom stream 17 from FSU-2 is the tailings comprising solids, water, asphaltenes, and residual solvent. Residual solvent 18 is recovered prior to the disposal of the tailings 19 in the tailings ponds (not shown). Such recovery is effected, for instance, using a tailings solvent recovery unit 20 (TSRU), a series of TSRUs or by another recovery method. Typical examples of operating pressures of FSU-1 and FSU-2 are respectively 550 kPag and 600 kPag. FSUs are typically made of carbon-steel but may be made of other materials. In such a process, significant fouling has been observed in FSU-2, and to a lesser extent in FSU-1. The foregoing is only an example of a PFT process.

Figure 2A:
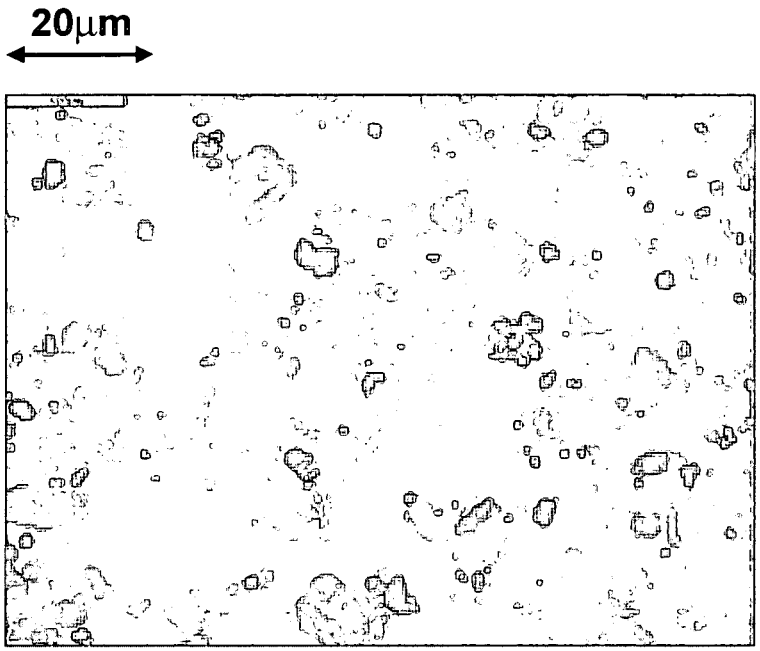
FIGS. 2*a* and 2*b* are scanning electron microscope (SEM) photographs of PFT foulants.
Figure 2B:
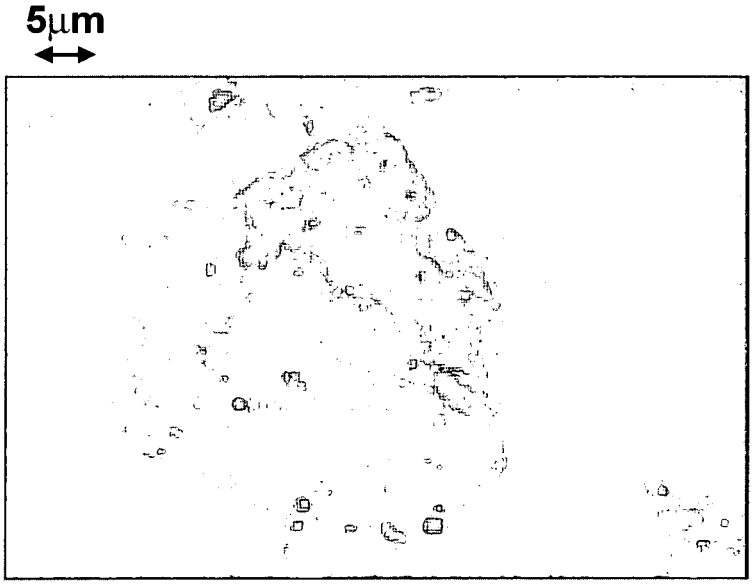

During pilot testing of a PFT process, the foulants of an FSU-1 and an FSU-2 (in a system as generally shown in FIG. 1) were analyzed. Foulant of FSU-1 comprised 46 percent volatiles (comprising water and pentane), 40 percent inorganics (comprising quartz, alumino-silicates, carbonates, $Fe_xS_y$, and titanium-rich minerals) and 14 percent NVHC (non-volatile hydrocarbons essentially comprising asphaltenes), all by weight. Foulant of FSU-2 comprised 50 percent volatiles (comprising water and pentane), 24 percent inorganics (comprising quartz, alumino-silicates, carbonates, $Fe_xS_y$, and titanium-rich minerals) and 26 percent NVHC (non-volatile hydrocarbons essentially comprising asphaltenes), all by weight. The foulant of FSU-2 had more asphaltenes than did the product bitumen. The H:C atomic ratio in the foulant was 1.2:1 to 1.3:1 compared to 1.35:1 in bitumen. Inorganics (quartz, alumino-silicates, $Fe_xS_y$, carbonates and $TiO_2$) identified in the foulant are similar to those typically present in the oil sands from which the bitumen has been extracted and made into a froth. The majority, by number, of the inorganic particulates is less than 1 μm in size. FIGS. 2*a* and 2*b* are scanning electron microscope (SEM) photographs showing evidence that the inorganics are held together by asphaltenes. In FIGS. 2*a* and 2*b*, the inorganics in the PFT foulant are light-colored and are glued together by the dark-colored asphaltenes.

In the examples below, it is shown that many materials may be used to collect foulant. This foulant may then be removed from the process. In this way, foulant build-up on the surface of the vessel or conduit as well as carry-over to downstream conduits, vessels and other equipment such as heat exchangers may be reduced. It was also found that the foulant was loosely attached to the coupons. That is, it was very friable and could easily be dislodged by squeezing it between two fingers or with a scraper. One way to dislodge the foulant is to use vibration to clean the collectors in situ without the need for taking them out from the vessels.

The foulant build-up in the vessel or conduit and carry-over are reduced by allowing foulant to deposit onto collectors placed inside the FSU vessels. The foulant collectors may be cleaned in situ by periodically vibrating them to dislodge the foulant, which can then be removed with the tailings from the bottom of the FSU vessels. An advantage of having less foulant carry-over is a reduced cleaning requirement of downstream conduits, vessels and process equipment. An advantage of having less build-up in the vessel or conduit is a reduced cleaning requirement of the vessel or conduit, and less downtime. In one embodiment, the foulant collectors are vibrated at their resonant frequency to dislodge foulant.

Figure 3:
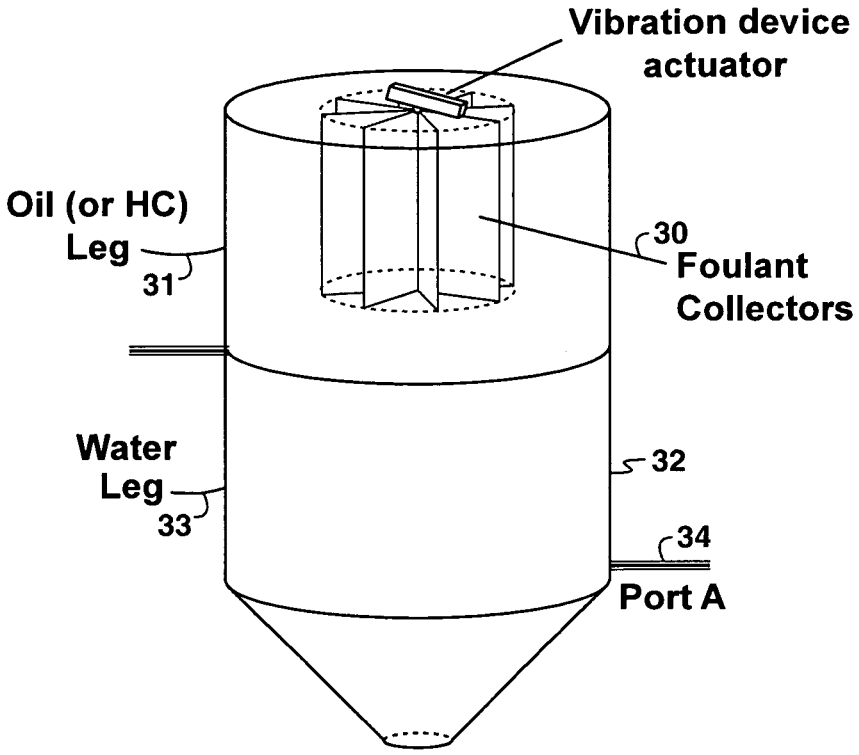
FIG. 3 is a schematic of an embodiment using foulant collectors and a vibration device actuator.

In one embodiment, the foulant captured by the collectors are periodically cleaned in situ, by vibrating them with an external vibration system. When foulant collects on the surface of the collectors to a pre-determined thickness or at another time, the collectors are lowered to the water leg of the FSU vessel and vibration is applied to dislodge the foulant, which is removed from the vessel through Port A (34 in. FIG. 3). In another embodiment, foulant is removed through the bottom of the vessel with the tailings.

An external vibration system may comprise one or more vibrators, such as pneumatic, electro-magnetic dynamic, or electro-piezo shakers. Designed to apply an intermittent or impact type of vibration to the collectors, these devices can generate sufficient dynamic force to dislodge the foulant from the surfaces. Design of the vibration system and selection of the operating parameters are coupled with the design of the collector. The amplitude of vibration generated at the surface of the collector by the vibrator system may be about 10 g or higher. Under certain conditions, the required amplitude of vibration may be lower than 10 g, for instance greater than 1 g. With lower vibration amplitude, the duration of applying vibration to dislodge the foulant from the collector may be longer. The repetitive impact frequency of the vibration system may be about 60 Hz or higher. Under certain conditions, the required frequency may be lower than 60 Hz, for instance greater than 1 Hz, with proper measures of minimizing effects of low frequency vibration on vessels, pipes, and other structures. The optimal vibration frequency of the vibration system may, in one embodiment, be selected so that it closely matches the primary natural frequency of the collector surfaces to produce the vibration resonance. At resonant frequency, it is easier to vibrate the collectors than at another frequency. The force on the foulant by the surface vibration, when sufficiently large, overcomes the foulant adhesion force and separates the foulant from the surface. Because of the composition of the foulant of the PFT process as discussed earlier, the adhesion force between the foulant and the collectors' surface is quite weak, as illustrated by the examples described below in which the friable nature of the loosely attached foulant is evident.

The concept of using vibration to remove the PFT foulant from the surface of the collectors is different from using it to prevent fouling of heat exchanger tubing where continuous shear vibration is required to keep the foulant in the fluid away from the surface. In a typical heat exchanger application, the vibration system is externally attached to the tubesheet, and effects the tube vibration through the transmission path of the tubesheet to the tubes. In the PFT application, continuous application of vibration energy may hinder foulant collection and only intermittent application is needed to dislodge the collected foulant when collectors' surface becomes saturated with the foulant or after a desired foulant accumulation level. Applying vibration to the PFT collectors is also easier than the heat exchanger application because of lower temperature in the PFT vessels and more direct vibration transmission to the collectors' surfaces. All of these factors combined improve the chance of success in dislodging the foulant from the surface.

A vibration device actuator may be present that emits sound waves to the collectors. The vibrator may be actuated at predetermined intervals of time, or as desired. The vibration can cause the loosely attached foulant to fall off as large particles which sink to the bottom of the vessel.

In one embodiment, the foulant collectors are lowered to the water leg in the vessel prior to actuation of the vibrator. In this embodiment, the foulant is dislodged in the lower water phase through which it is removed with the tailings.

In yet another embodiment, the foulant collectors are cleaned by lifting them out of the vessel during scheduled maintenance, or at another time.

In yet another embodiment, the foulant collectors are used in conjunction with an anti-fouling coating applied to the inner walls of the vessels. In this case, the foulant that does not deposit on the anti-fouling coating is gathered by the foulant collectors, and does not get carried over to the downstream equipment.

An embodiment is illustrated in FIG. 3. The array of foulant collectors 30 is suspended in the oil leg 31 of the vessel 32. In both FSU-1 and FSU-2, the upper part is the hydrocarbon (HC) leg 31 and the lower part is the water leg 33. The foulant collectors 30 have surface areas and surface energies appropriate to collect foulant. As a result, foulant carry-over to the equipment and conduits downstream of the vessel is reduced. The foulant collectors may be of a variety of shapes. The foulant collecting surfaces may be flat, concave, convex, or of another shape.

In one embodiment, the foulant collectors 30 are placed only in FSU-1 and not in FSU-2, to reduce build-up and/or carry-over. The overflow stream from FSU-1 is the solvent-diluted bitumen product that is processed downstream and passes through conduits, equipment and vessels. On the other hand, the overflow stream from FSU-2 is passed to, and processed in, FSU-1 and therefore does not pose the same downstream fouling issues. This embodiment reduces the cost of practicing the invention by applying it to only one vessel. This does not preclude using foulant collectors in both FSU's.

As shown in the examples below, the following materials were found effective to collect foulant: carbon steel, ceramics, cement, rubber, Teflon®, Fibre Reinforced Plastic (FRP), and Diamond-Like-Carbon (DLC). These materials are not intended to be preferred materials. Rather, they merely show that many materials can be effective, even Teflon® which is generally considered to be a non-stick surface. For instance, the material may be a metal, a ceramic, a polymer, or a composite.

A solid material's surface energy is often determined by measuring liquid contact angles including water contact angle(s). Water contact angle is the angle at which a water interface meets the solid surface. Water contact angle is described in "Polymer Interface and Adhesion," S. Wu, Marcel Dekker, New York (1982). As described below in the Examples section, water contact angles were measured herein using a VCA2500XE Video Contact Angle Analyzer from AST Products, Inc. (Billerica, Mass.). Water contact angle as used herein thus refers to that measured using a VCA2500XE.

The higher the contact angle, the lower the surface energy. On extremely hydrophilic surfaces, a water droplet will completely spread (an effective contact angle of 0 degrees). This occurs for surfaces that have a large affinity for water (including materials that absorb water). On certain hydrophilic surfaces, water droplets will exhibit contact angles of 10 degrees to 30 degrees. On highly hydrophobic surfaces, which are incompatible with water, one observes a large contact angle (70 degrees to 90 degrees, or greater). The contact angle thus provides information on the interaction energy between the surface and water. Thus, a material with a sufficiently high surface energy may be useful herein. That is, the water contact angle with the solid surface may be below a maximum value. In one embodiment, the material has an average water contact angle of less than 115 degrees, less than 110 degrees, less than 100 degrees, or less than 90 degrees.

Non-uniformity of surface energy also assists foulant collection. To quantify uniformity, standard deviation is used herein. In particular, for the purposes of quantitative comparison, standard deviation of a surface's water contact angles is divided by the surface's average water contact angle. In this way, relative deviation is assessed. A Teflon®-coated coupon (as used in Example 4) was tested and showed water contact angles of 55 degrees, 100 degrees, and 120 degrees, which calculates to an average of 91.7 degrees, a standard deviation of 33.9 degrees, and a standard deviation of water contact angles divided by the average water contact angle of about 0.36. The surface is relatively non-uniform. On the other hand, a LEAP coupon (as shown in Comparative Example A) was shown to have the following water contact angles: 116.9 degrees, 115 degrees, 112 degrees, 112 degrees, 117.9 degrees, 116.5 degrees, 117 degrees, 116.5 degrees, and 116.5 degrees, which calculates to an average of 115.2 degrees, a standard deviation of 1.92 degrees, and a standard deviation of water contact angles divided by the average water contact angle of 0.017, i.e. relatively uniform. In one embodiment, the water contact angles of a surface has a standard deviation divided by the average water contact angle of greater than 0.1, or greater than 0.2, or greater than 0.3. In one embodiment, the standard deviation is greater than 5 degrees, or greater than 10 degrees, or greater than 20 degrees, or greater than 30 degrees.

A non-uniform composition may be useful to provide nucleation sites causing foulant to grow and build. A non-uniform composition also facilitates dislodging. In one embodiment, the foulant collecting surface may have impurities having an average water contact angle of greater than 90 degrees in an amount greater than 1000 ppmw. The impurity content may be much higher than 1000 ppmw.

In order to assist preferential foulant collection on the foulant collector over collection on the vessel or conduit walls, the surface area of the foulant collector (or total surface area of all foulant collectors where more than one collectors are used) may be greater than an area of a portion of the vessel or conduit which collects foulant in the absence of the foulant collector. In certain embodiments, the foulant collection area is greater by at least 10 percent, or by at least 20 percent, or by at least 30 percent, or by at least 40 percent, or by at least 50 percent. By 'preferential', it is meant that more foulant will collect on the foulant collector(s) than on the portion of the vessel or conduit which collects foulant.

Additional Use of a Fluorocarbon Polymer for Reducing Fouling

Together with the use of a foulant collector, a fluorocarbon polymer may be used as a separate surface for reducing fouling. For instance, an FSU vessel may have an inner surface for reducing fouling (e.g. a LEAP material described below in Comparative Example A) and a foulant collector (e.g. carbon steel) may be disposed within the FSU for collecting foulant to be subsequently removed to reduce foulant build-up and/or carry-over. In this instance, the foulant collectors may be subjected to more frequent cleaning or dislodging action. Surfaces for reducing fouling will now be described further.

As shown in Comparative Example A, certain materials with sufficiently low surface energy and of sufficient purity are effective in reducing PFT fouling on the materials. That is, using such a material limits accumulation of foulant on the material. Such materials may therefore by used as an inner surface of a PFT vessel or conduit. In one embodiment, the material has an average water contact angle of at least 90 degrees; or at least 100 degrees, or at least 110 degrees, or at least 115 degrees, or about 116 degrees to about 123 degrees. In one embodiment, the average water contact angle is no more than 170 degrees and at least 90 degrees, or at least 100 degrees, or at least 110 degrees, or at least 115 degrees.

Uniformity of surface energy also assists a reduction in fouling. In one embodiment, the water contact angles of a surface has a standard deviation divided by the average water contact angle of less than 0.1, or less than 0.05, or less than 0.03, or less than 0.02, lower values indicating more uniform surfaces in terms of surface energy. In one embodiment, the standard deviation is less than 20 degrees, less than 10 degrees, less than 5 degrees, less than 3 degrees, or less than 2 degrees.

Purity of the material is desirable to assist foulant accumulation because a non-uniform composition may provide for nucleation sites causing foulant to grow and build. Impurities are defined herein as anything other than the monomer(s) of the homopolymer or copolymers used. Copolymer is not limited to only two monomers. In one embodiment, the material has an impurity content of less than: 1000 ppmw, or 100 ppmw, or 10 ppmw, or 1 ppmw, or 100 ppbw, or 10 ppbw.

The material may be a fluoroplastic, for instance PTFE (polytetrafluoroethylene)-based polymers, meaning homopolymers of TFE (tetrafluoroethylene) or copolymers of TFE with one or more monomers comprising at least one ethylene-type unsaturation. In certain embodiments, the comonomer content is less than 2 percent or less than 1 percent, by weight. The comonomers having ethylene-type unsaturation which can be used are both of hydrogenated and fluorinated type; among the hydrogenated ones it can be mentioned: ethylene, propylene, acrylic monomers, for example methylmethacrylate, (meth) acrylic acid, butylacrylate, hydroxyethylhexylacrylate, styrene monomers. Among the fluorinated comonomers it can be mentioned:

$C_3$-$C_8$ perfluoroolefins, such as hexafluoropropene (HFP);

$C_2$-$C_8$ hydrogenated fluoroolefins, such as vinyl fluoride (VF), vinylidene fluoride (VDF), trifluoroethylene, hexafluoroisobutene, perfluoroalkylethylene $CH_2{=}CH{-}R_f$, wherein $R_f$ is a $C_1$-$C_6$ perfluoroalkyl;

$C_2$-$C_8$ chloro- and/or bromo- and/or iodo-fluoroolefins, such as chlorotrifluoroethylene (CTFE);

$CF_2{=}CFOR_f$ (per) fluoroalkylvinylethers (PAVE), wherein $R_f$ is a $C_1$-$C_6$ (per) fluoroalkyl, for example $CF_3$, $C_2F_5$, $C_3F_7$; and $CF_2{=}CFOX$ (per) fluoro-oxyalkylvinylethers, wherein X is: a $C_1$-$C_{12}$ alkyl, or a $C_1$-$C_{12}$ oxyalkyl, or a $C_1$-$C_{12}$ (per) fluoro-oxyalkyl having one or more ether groups, for example perfluoro-2-propoxy-propyl, fluorodioxoles, preferably perfluorodioxoles.

Examples of embodied comonomers include a $C_3$-$C_8$ perfluoroolefin, a $C_2$-$C_8$ chloro-, bromo- and/or iodo-fluoroolefin, a (per) fluoroalkylvinylether of formula $CF_2{=}CFOR_f$ (PAVE), wherein $R_f$ is a $C_1$-$C_6$ (per) fluoroalkyl, a (per) fluoro-oxyalkyvinylether of formula $CF_2{=}CFOX$, wherein X is a $C_1$-$C_2$ alkyl, a $C_1$-$C_{12}$ oxyalkyl, and a $C_1$-$C_{12}$ (per) fluoro-oxyalkyl having one or more ether groups.

Other suitable polymers include: PFA (perfluoroalkoxy), FEP (fluorinated ethylene propylene), ETFE (ethylene tetrafluoroethylene), ECTFE (ethylene chlorotrifluoroethylene), PVDF (polyvinylidene fluoride), or PCTFE (polychlorotrifluoroethylene).

The material may also be a fluorocarbonelastomer or a tetrafluorocarbonelastomer. An example of a fluorocarbonelastomer is a copolymer of vinylidene fluoride and hexafluoropropylene, an example of which is commercially known as Viton™.

Polymers sold under the Teflon® name currently comprise PTFE, PFA (perfluoroalkoxy), or FEP (fluorinated ethylene propylene). A Teflon® spray coated surface is proven ineffective as a foulant collecting surface below. In order to apply such a Teflon® coating, certain additives (or fillers) are used to permit or assist spraying and adhesion. Without being bound by theory, such additives are believed to be a factor in this ineffectiveness. Therefore, a Teflon®-type material may be useful provided that the additives are sufficiently reduced to obtain a sufficiently high purity and provided that the surface energy is low enough. To accomplish this, spraying may be avoided. For instance, a piece of material may be manufactured, for instance by molding, out of PTFE and affixed to, or suspended within, a vessel or conduit used in the PFT process.

Because of the purity and maximum surface energy requirements, alternative ways of creating a surface may be used, although spraying could be used if the purity and surface energy requirements are met. Such alternative ways of applying a surface may depend on, for instance, the vessel or conduit, and the particular material selected. In one embodiment, pieces of material of convenient size are fabricated and a plurality of such pieces is inserted into slots to cover at least a portion of the walls of a vessel. Such pieces could alternatively be adhered or affixed to the inside of the vessel or conduit. The surface may be applied to any portion of the vessel or conduit and need not cover it entirely. For instance, the surface may be applied to areas where foulant would otherwise significantly or preferentially accumulate. Alternatively, the conduit or vessel itself could be made of the material. Painting could also be used to create the surface.

In one embodiment, the material is a material in accordance with ASTM D 4894-98a, Type I, II, III, or IV (any of the grades). This standard covers granular resins for polytetrafluoroethylene (PTFE) that have never been preformed or molded and are normally processed by methods similar to those used in powder metallurgy or ceramics or special extrusion processes. The PTFE resins of this ASTM standard are homopolymers of tetrafluoroethylene, or, in some cases, modified homopolymers containing no more than one percent by weight of other fluoropolymers. The materials of this ASTM standard do not include mixtures of PTFE resin with additives such as colorants, fillers or plasticizers; nor do they include processed or reground resin. The resin of this ASTM standard is said to be uniform and contain no additives or foreign material.

In one embodiment, the fluorocarbon polymer may be made by molding, isostatic molding, and/or using a material as specified by ASTM D 4894-98a or ASTM D 4895-04.

The use of foulant collectors together with a fluorocarbon polymer for reducing fouling may be particularly advantageous. For instance, where an FSU vessel has an inner surface for reducing fouling, some foulant that would otherwise accumulate on the vessel walls will remain in the process fluid as an additional foulant. A portion of this additional foulant may be collected by the foulant collectors.

In one embodiment, rather than using foulant collectors, or in addition to using foulant collectors, foulant that collects on the vessel or conduit walls may be dislodged by vibrating or applying an impact force to the vessel or conduit itself. A system similar to that used for dislodging foulant from the foulant collectors, as discussed above, but suitable to the vessel or conduit, may be used. The vibrating may be effected using a vibration system external to the vessel or conduit. The vibration system may comprise one or more vibrators, the vibrators being pneumatic, electro-magnetic dynamic, or electro-piezo shakers. The placement and/or number of vibrators may be selected so as to effectively dislodge the collected foulant. The vibration on the foulant collector surface may have an amplitude of 1 g or higher and an impact frequency of 1 Hz or higher. The vibration may be actuated by a vibration actuator that emits sound waves to the foulant collecting surface. The vibration may be effected at predetermined intervals of time, upon command, or continuously.

EXAMPLES

The water contact angle measurements described in these examples were obtained using a VCA2500XE Video Contact Angle Analyzer from AST Products, Inc. (Billerica, Mass.).

The carbon steel (CS) mentioned in these examples is 1080 steel.

The examples show that various materials can collect foulant inside the FSU-1 and FSU-2 units of the PFT vessels.

All of the examples are from tests carried out in the 30 bbl/day PFT continuous pilot. The pilot ran continuously for 72 hours followed by a weekend shutdown, and then for another 72 hours continuous run, followed by a one-week maintenance shutdown and so on.

For the carbon steel coupon, a small coupon (5.1 cm L, 1.3 cm wide and 0.16 cm thick) was used. The coupons were suspended from the top of the settler pipe section of FSU-1 and FSU-2 using stainless steel hooks and examined after each 72-hour continuous run. For quantitative comparison of the coupons with varying sizing and shapes, the foulant capture per unit surface area was calculated.

Example 1

Carbon Steel, Cement, and Ceramic Materials in FSU-1

Three materials: carbon steel, cement and a ceramic (Kalceram™, from Abresist Corporation, Urbana, Ind.) were evaluated as small coupons made from each material.

Figure 4A:
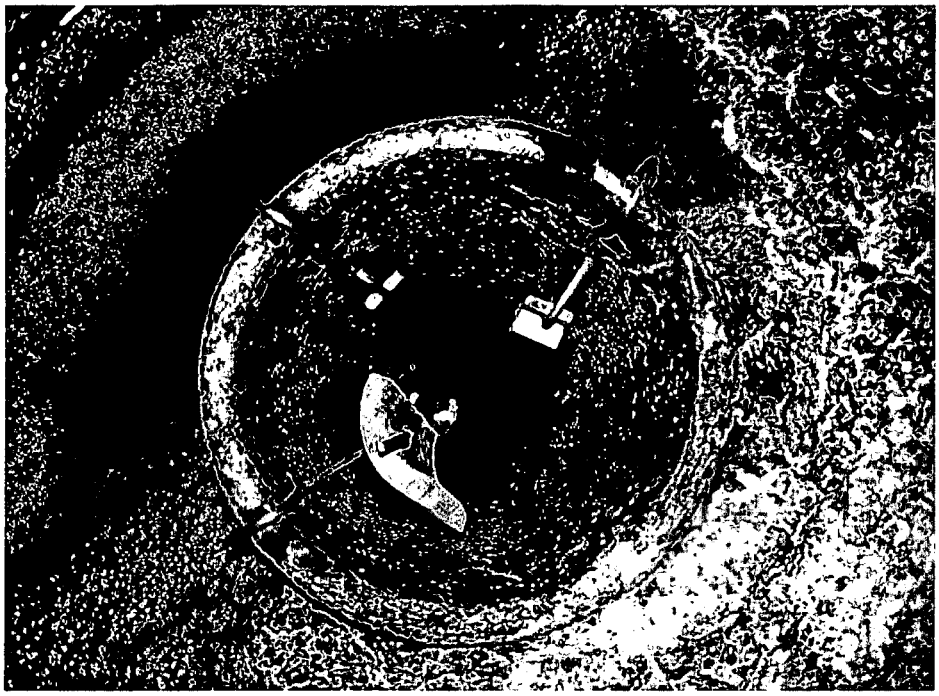
FIGS. 4*a* and 4*b* are photographs of cement, carbon steel, and ceramic coupons in FSU-1, before (4*a*) and after (4*b*) exposure, as described in Example 1.

Each coupon was suspended by a steel wire from the top of the settler pipe section in FSU-1 (FIG. 4*a*). After being exposed continuously to the FSU-1 hydrocarbon over a period of 72 hours, all three coupons collected a significant amount of foulant.

This example shows that all three of these materials collected foulant that would otherwise be carried over downstream.

Example 2

Carbon Steel, Cement and Ceramic Materials in FSU-2

Figure 5A:
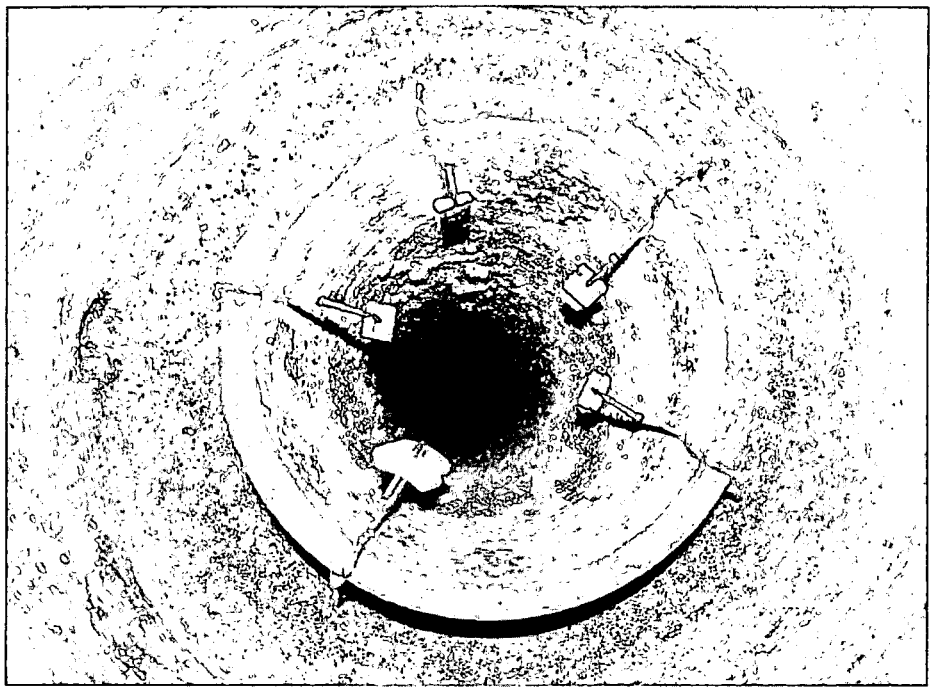
FIGS. 5*a* and 5*b* are photographs of five foulant collecting materials, before (5*a*) and after (5*b*) exposure in FSU-2, as described in Example 2.

Five materials: carbon steel, three ceramics (Abresist™, Alresist™ and Kalceram™, all from Abresist Corporation, Urbana, Ind.) and cement were evaluated in FSU-2. The coupons from these materials are shown in FIG. 5*a* before the run. After a 72-hour run, all the coupons collected a significant amount of foulant (FIG. 5*b*).

Each material was successful in collecting foulant material from the FSU-2 hydrocarbon stream, thereby demonstrating its effectiveness in reducing foulant build-up and carry-over to the equipment, conduits and vessels downstream of the FSU-2.

Figure 4B:
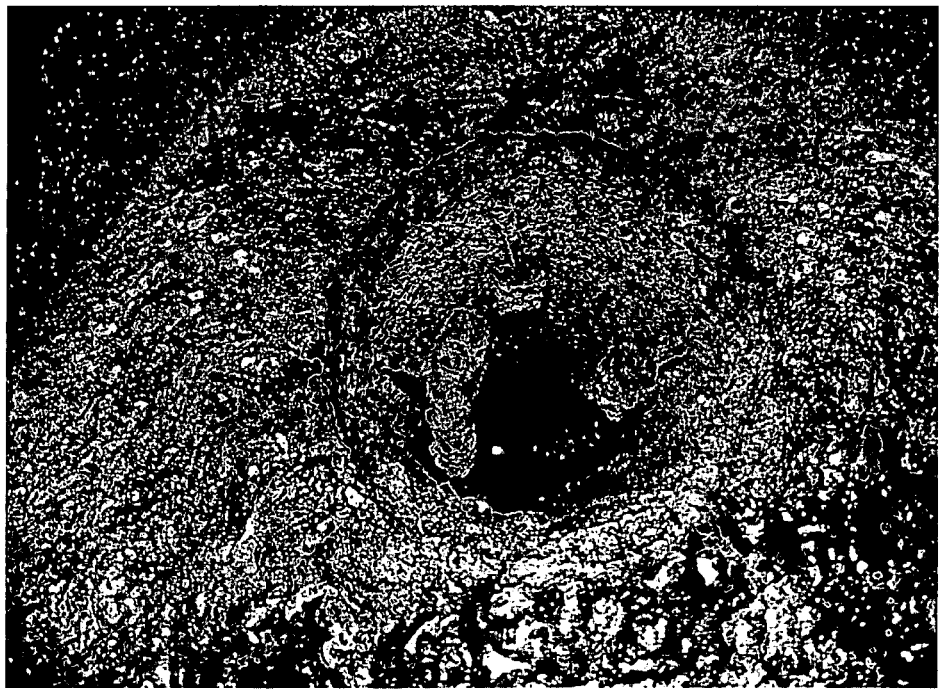
Figure 5B:
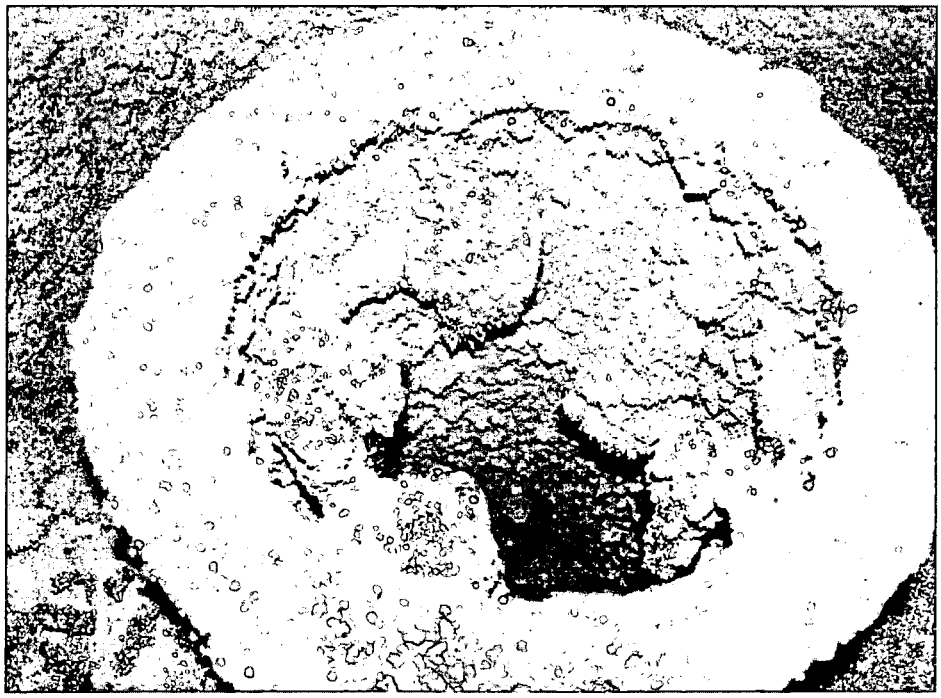

The higher amount of foulant build-up in all the FSU-2 coupons compared to FSU-1 coupons is evident when FIG. 5*b* in Example 2 is compared with FIG. 4*b* in Example 1. This is also evident when the carbon-steel coupon from FSU-2 (FIG. 6*b*) is compared with that from FSU-1 (FIG. 6*a*).

Figure 6A:
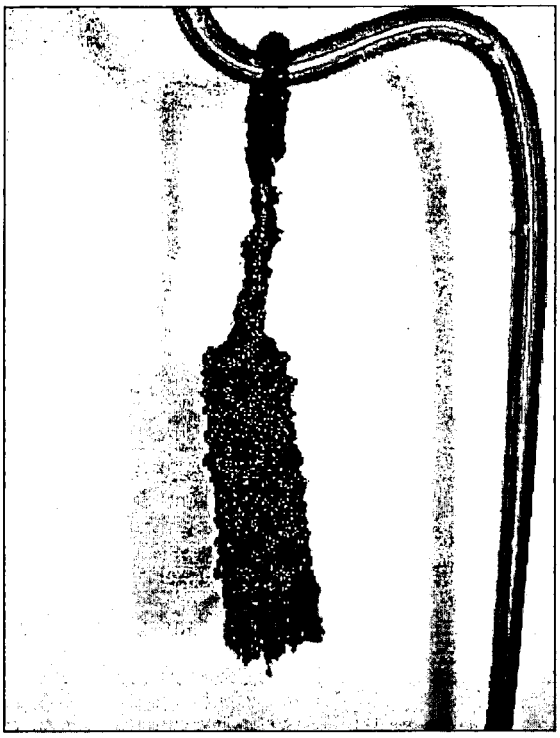
FIGS. 6*a* and 6*b* are photographs of carbon steel coupons after exposure in FSU-1 (6*a*) and FSU-2 (6*b*), as described in Example 2.
Figure 6B:
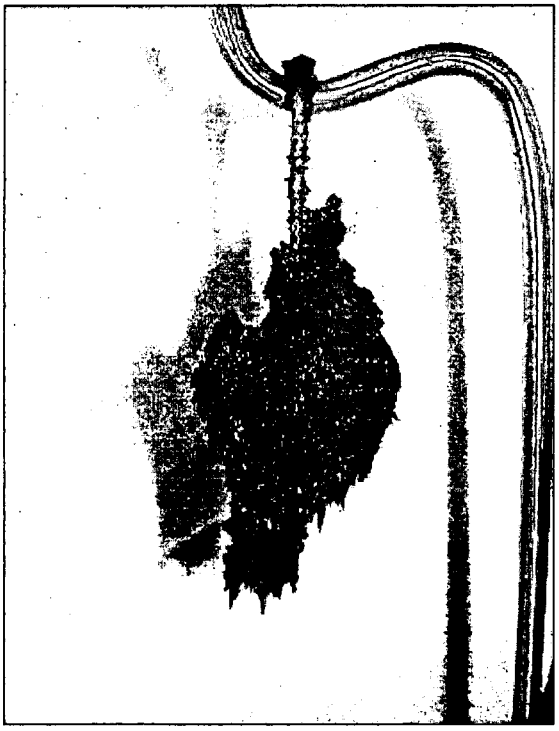

The friable nature of the foulant is also evident from FIGS. 6*a* and 6*b*, as some of it fell off from the stainless steel hook (used to hang the coupon) and the top part of the coupon. This was further demonstrated by easily crumbling the foulant by squeezing it between two fingers and easily dislodging it from the coupon.

Figure 7:
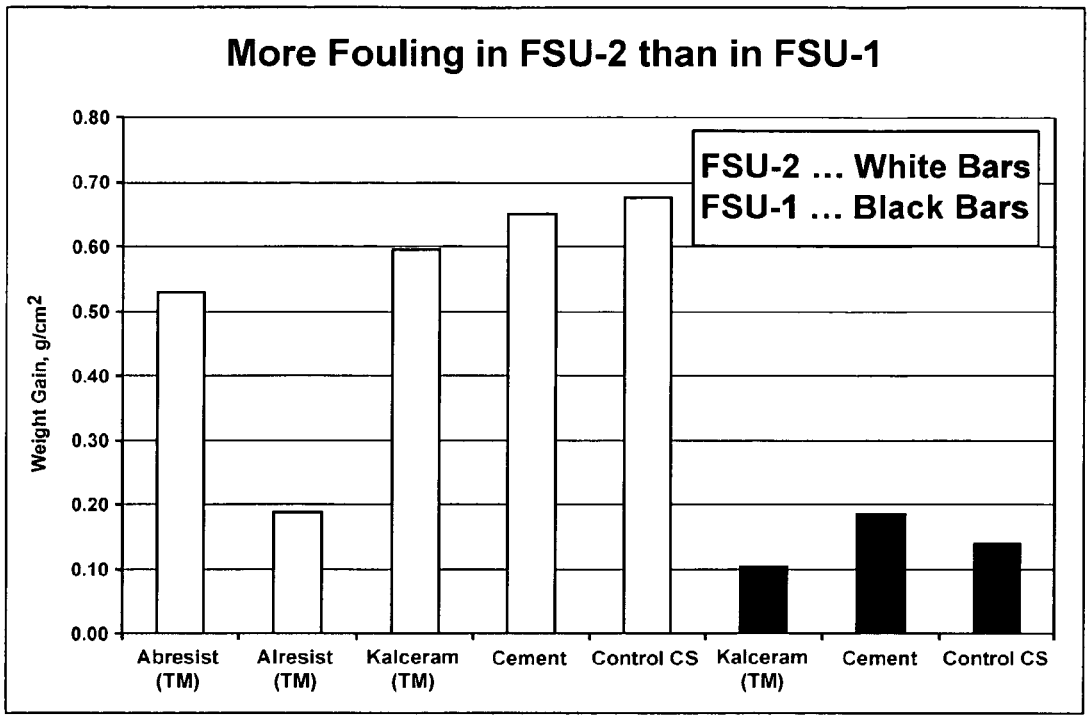
FIG. 7 is a graph showing normalized weight gain of various samples in FSU-1 and FSU-2, as described in Examples 1 and 2.

For the materials listed in Examples 1 and 2, the weight gain by each coupon was measured, normalized by the total surface area and reported as weight gain per $cm^2$. FIG. 7 shows the weight gain by the coupons in FSU-1 and FSU-2 after a 72-hour run. The higher foulant build-up in FSU-2 is again apparent in each of the coupons.

It should be noted that, of the materials tested, carbon steel collected the most foulant per unit surface area followed by cement. The Alresist™ coupon appeared to have collected the least amount of foulant, presumably because of some of the loosely attached foulant falling off from this coupon prior to weighing.

Example 3

Repeat Evaluation of Materials of Example 1 and 2, in FSU-1 and FSU-2

Figure 8:
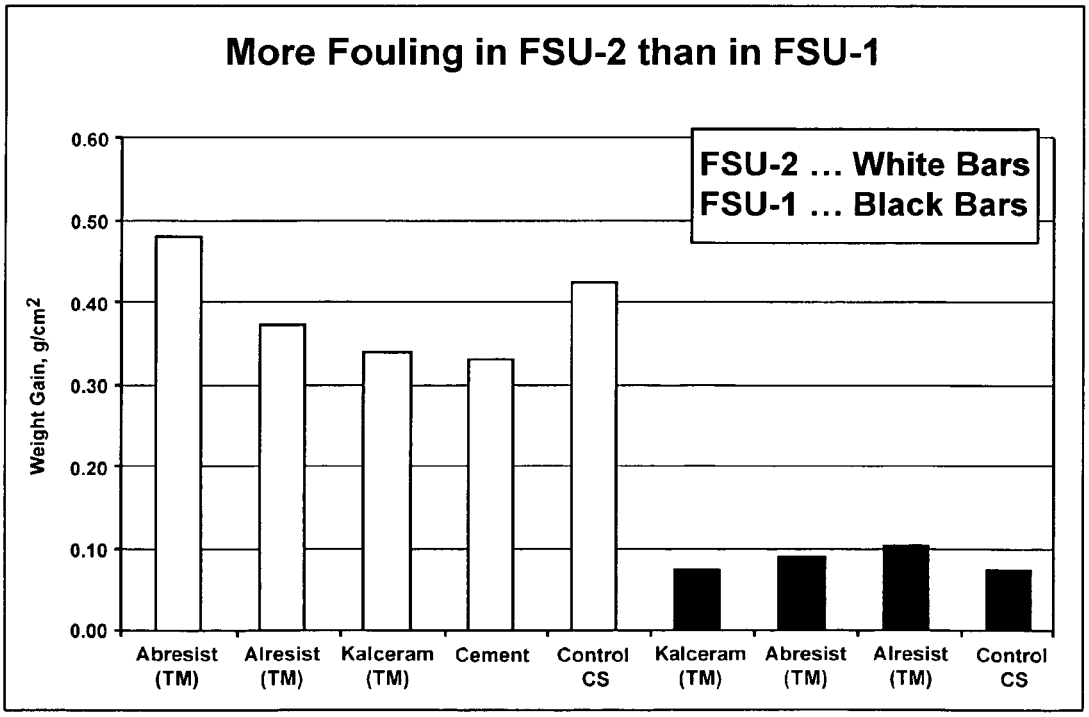
FIG. 8 is a graph showing normalized weight gain of various samples in FSU-1 and FSU-2, as described in Example 3.

This example shows the results from the repeat tests of those in Examples 1 and 2. The coupon materials and the exposure time of 72-hour in the repeat tests were the same as those in Examples 1 and 2. The weight gains by the coupons in the repeat tests are shown in FIG. 8.

The reproducibility in the weight gain by the coupons (by comparing FIG. 8 with FIG. 7) was reasonable in view of the fact that some foulant might have fallen off because of the friable nature of the foulant. As in Examples 1 and 2, all of the materials evaluated in the repeat tests collected foulant, with the Abresist™ showing the most collection, followed by carbon steel. The Alresist™ coupon in the repeat test showed weight gain which was in line with those by the other coupons, confirming the hypothesis that its relatively lower weight gain in Example 2 was due to some of the foulant falling off prior to weighing. Consistent with Examples 1 and 2, the repeat tests also showed higher fouling in FSU-2 than FSU-1.

Example 4

Materials with Surface Heterogeneity

This example shows that surface heterogeneity plays a role in collecting the foulant. The following two materials were evaluated in FSUs as small coupons for a 72-hour continuous run:

1. Teflon®-coated carbon steel (FIGS. 9*a* and 9*b*) in FSU-1; and
2. FRP (Fibre Reinforced Plastics; FIGS. 10*a* and 10*b*) in FSU-2.

The Teflon®-coupon had an additive to make it adhere to the surface of application during spray coating. Its surface heterogeneity was confirmed by water contact angle measurements (as discussed below), which showed significant variations. The FRP also had surface heterogeneity introduced by the incorporation of the fibers into the plastic matrix.

Figure 9A:
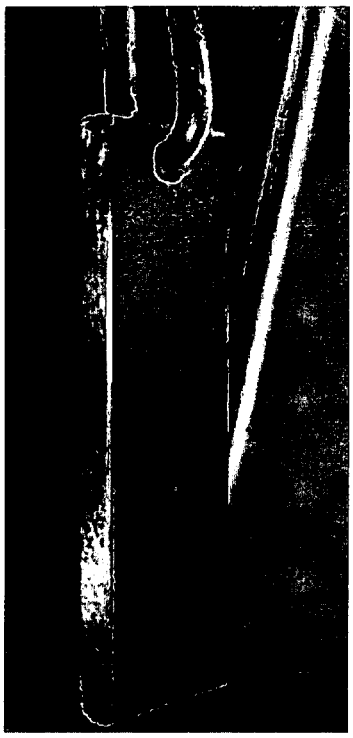
FIGS. 9*a* and 9*b* are photographs of Teflon®-coated carbon steel before (9*a* and after (9*b*) exposure in FSU-1, as described in Example 4.
Figure 9B:
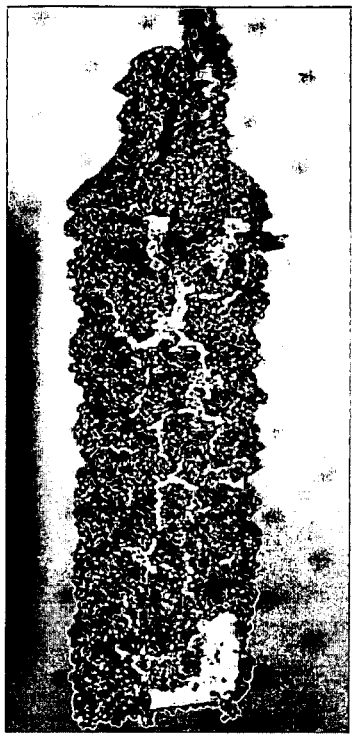
Figure 10A:
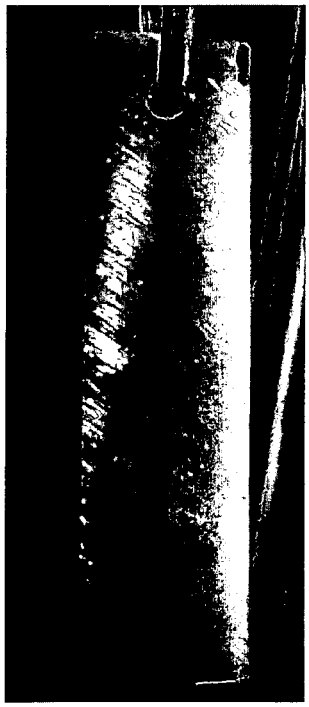
FIGS. 10*a* and 10*b* are photographs of FRP (Fibre Reinforced Plastic), before (10*a*) and after (10*b*) exposure in FSU-2, as described in Example 4.
Figure 10B:
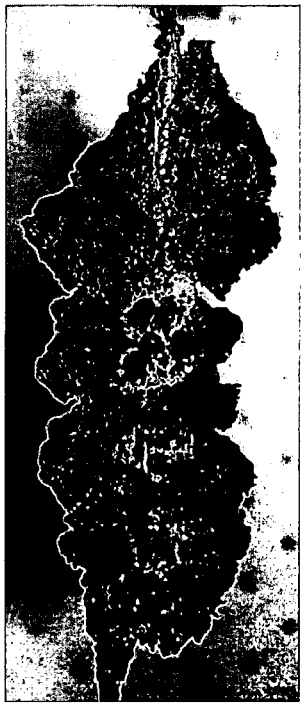
Figure 11:
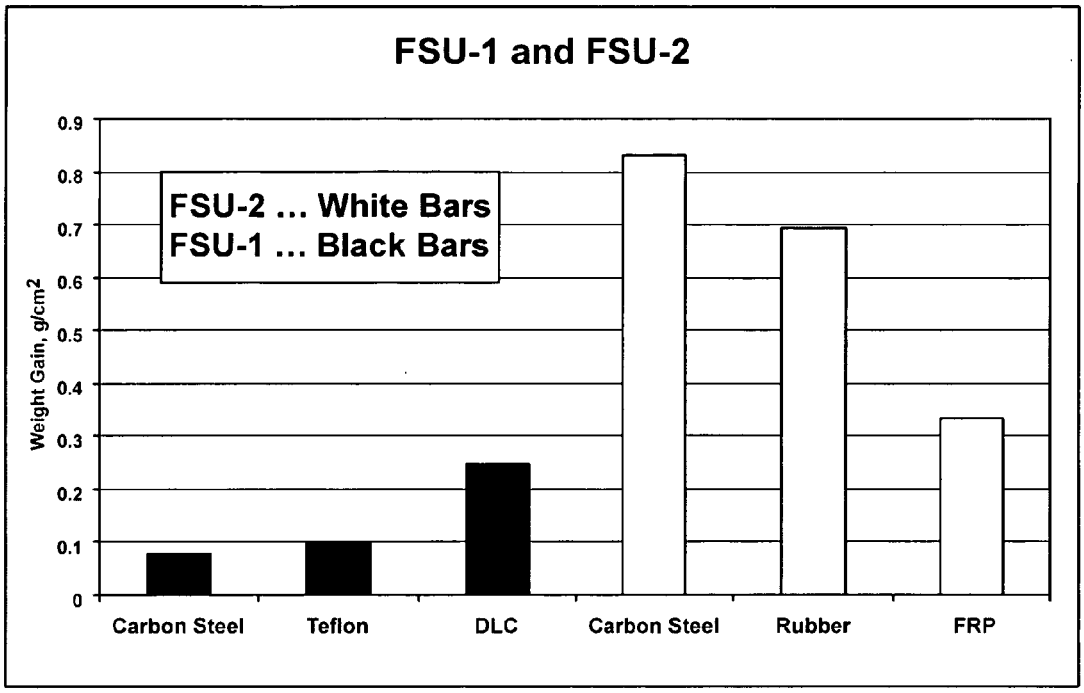
FIG. 11 is a graph showing foulant collected as measured by weight gain for various samples, as described in Examples 4 and 5.

FIGS. 9 and 10 are the "Before" (FIGS. 9*a* and 10*a*) and "After" (FIGS. 9*b* and 10*b*) photographs of the Teflon®-coated carbon steel and the FRP coupons, respectively. FIG. 11 shows the normalized weight gains ($g/cm^2$) by these coupons, along with carbon steel control coupons used in the same tests for comparison.

The following observations are made from the testing of the Teflon® and the FRP coupons:

The Teflon®-coated carbon steel coupon had some isolated streaks (presumably due to eterogeneity in the surface) that were not fouled (white areas in the coupon) (FIG. 9*b*). It also gained slightly more weight than the control carbon steel coupon (FIG. 11). The Teflon® coated coupon was tested and showed water contact angles of 55 degrees, 100 degrees, and 120 degrees, which calculates to an average of 91.7 degrees, a standard deviation of 33.9 degrees, and a standard deviation of water contact angles divided by the average water contact angle of about 0.36. The surface is relatively non-uniform. For a comparison, a relatively uniform surface is described in Comparative Example A.

The RFP coupon also had a few streaks of un-fouled areas (FIG. 10*b*) and its weight gain was lower than that by the carbon steel coupon (FIG. 11).

This example shows that the Teflon®-coated carbon steel coupon and the FRP material are not completely covered with the foulant because of surface heterogeneity. Without intending to the bound by theory, this incomplete coverage may offer openings for vibration energy to work from and help removal of the foulant from the plates. In both materials, the collected foulant was also quite friable in nature and could easily be dislodged by scraping with a finger.

Example 5

Diamond-Like Carbon (DLC) and Rubber

Figure 12A:
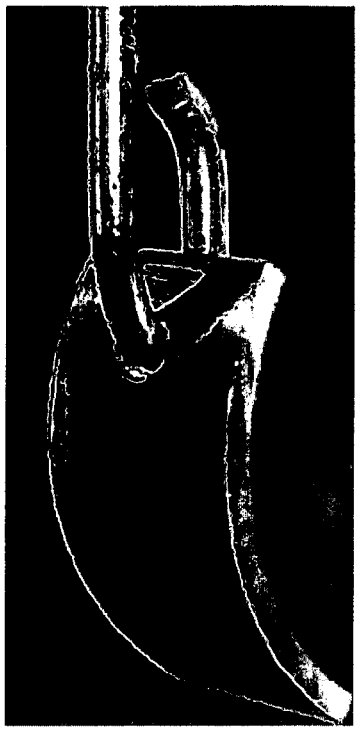
FIGS. 12*a* and 12*b* are photographs of a DLC (Diamond-Like Carbon) coupon before (12*a*) and after (12*b*) exposure in FSU-1, as described in Example 5.
Figure 12B:
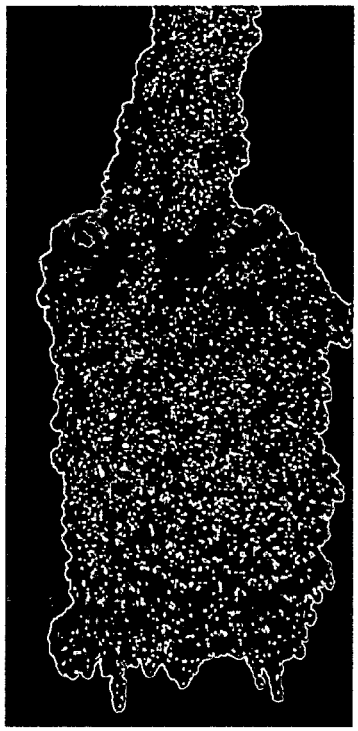

In this example, a DLC coupon (from Sub-One Technology, Pleasonton, Calif.) and a rubber coupon (N-75-43-4 rubber from Zeon Chemicals, Louisville, Ky.) were evaluated in FSU-1 and FSU-2, respectively. Both coupons, especially the DLC coupon, were expected to prevent fouling. Instead, both were shown to be good collectors of foulant (FIG. 11). Perhaps because of its concave shape, the DLC coupon collected more foulant than the carbon steel coupon under the same test conditions in FSU-1 (FIGS. 11 and 12).

Example 6

Repeat Evaluation of Carbon Steel Material in FSU-1

To verify the reproducibility of the foulant collecting capability of the carbon steel material, a carbon steel coupon similar in size and properties to those in Examples 1 and 2, was exposed to the FSU-1 hydrocarbon slurry for a period of 72 hours.

Figure 13A:
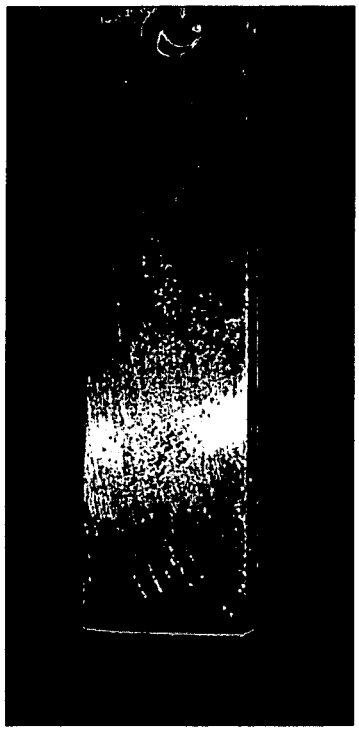
FIGS. 13*a* and 13*b* are photographs of a carbon steel coupon before (12*a*) and after (13*b*) exposure in FSU-1, as described in Example 6.
Figure 13B:
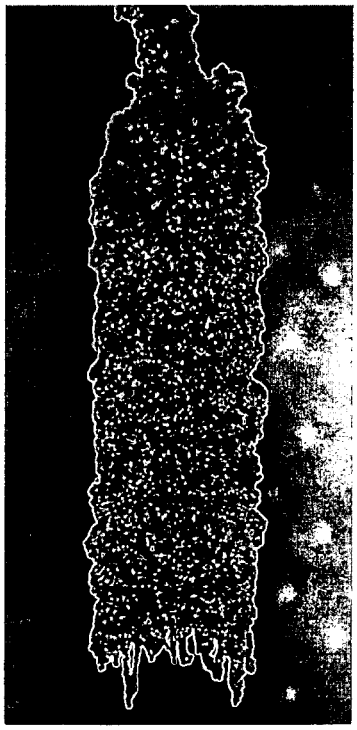

FIGS. 13*a* and 13*b* show the carbon steel coupon before and after exposure. The capture of foulant after 72 hours of exposure is quite substantial.

This example confirms previous observations that the carbon steel material is a good collector of foulant from FSU-1.

Example 7

Repeat Evaluation of Carbon Steel Material in FSU-2

To check the reproducibility of the foulant collecting capability, a carbon steel coupon similar in size and properties to those in Examples 1, 2 and 5 was exposed to FSU-2 hydrocarbon slurry for a period of 72 hours.

Figure 14A:
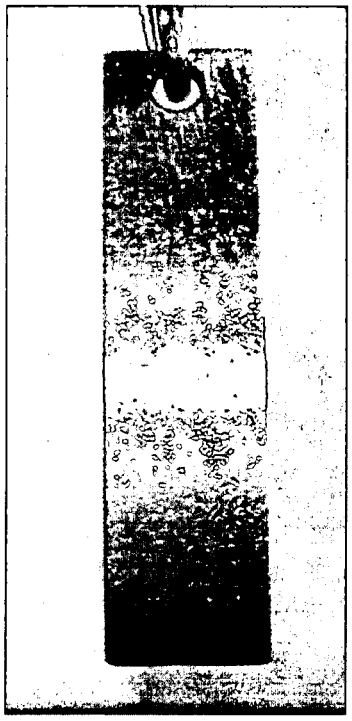
FIGS. 14*a* and 14*b* are photographs of a carbon steel coupon before (12*a*) and after (14*b*) exposure in FSU-2, as described in Example 7.
Figure 14B:
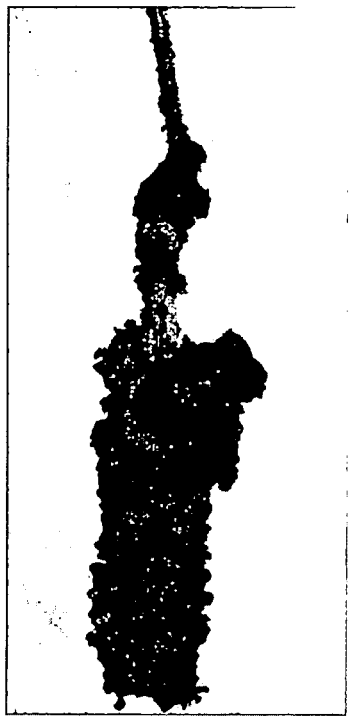

FIGS. 14*a* and 14*b* show the carbon steel coupon before and after exposure. The capture of foulant after 72 hours of exposure is quite substantial. Also evident is the friable nature of the foulant, some of which was already dislodged from the stainless steel hook and the upper part of the coupon.

Comparative Example A

In Example 4, a Teflon®-coated coupon was described as relatively non-uniform. A relatively uniform surface will now be described.

Figure 15A:
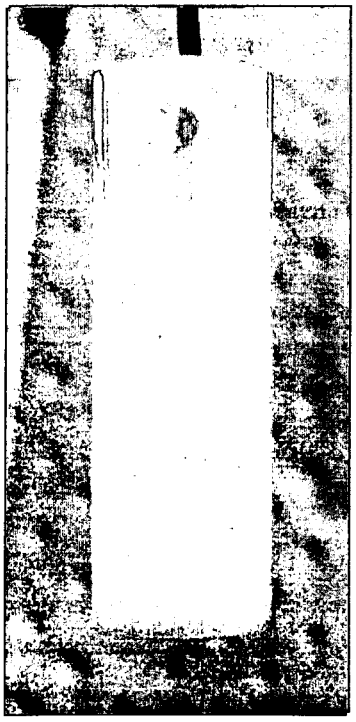
FIGS. 15*a* and 15*b* are photographs of a coupon described in Comparative Example A; before (15*a*) and after (15*b*) exposure in FSU-1.
Figure 15B:
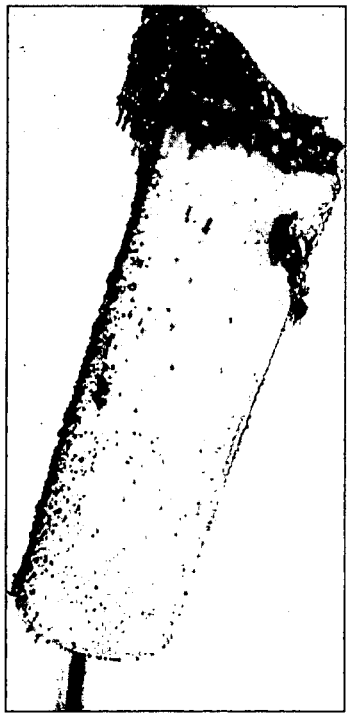

A "LEAP" coupon (wherein "LEAP" stands for Low Energy And Of Pure Composition) made of PTFE (polytetrafluoroethylene) and falling under the designation "PTFE636-N" was supplied by Endress+Hauser Canada of Burlington, ON, Canada. The coupon had an internal diameter of 1.5 cm and a length of 5.1 cm and was cut from a tube fabricated by extrusion of a pure-grade material with a surface roughness of less than 0.45 μm. The LEAP coupon was placed in the same area and in the same manner as the coupons in Examples 1 to 7; the LEAP coupon was exposed to FSU-1 slurry along with a carbon steel control coupon for a period of 72 hours. FIGS. 15*a* and 15*b* show the LEAP coupon before (FIG. 15*a*) and after (FIG. 15*b*) exposure in FSU-1.

The LEAP coupon compared to the control carbon steel coupon was remarkably clean after the same amount of exposure. The foulant seen near the top and on the left side of the coupon deposited initially on the stainless steel hook used to hang the coupon inside FSU-1. The foulant later draped over to the side of the coupon.

Water contact angle measurements were taken at nine different locations on the surface. The following angles (in degrees) were observed: 116.9, 115.0, 112.0, 112.0, 117.9, 116.5, 117.0, 116.5, and 116.5 calculating to an average of 115.2 degrees. The standard deviation is 1.92 degrees. The standard deviation divided by the average is 0.02.

This example shows that LEAP material reduces foulant build-up in FSU-1 and thus is not preferred for use as a foulant collector. The Teflon®-coated coupon of Example 4, on the other hand, is suitable.

In summary, the above examples show that all the materials evaluated (except for the LEAP material of Comparative Example A) were effective in capturing foulant, which otherwise would have escaped into the equipment, vessels and conduits downstream of the FSU vessels and caused foulant-related problems there.

Of the materials tested, carbon steel seems to be the most effective in capturing the most foulant per unit area, albeit taking into account the variation in the weight gain. It is also the least expensive of those tested and its use should not create any, or any unsatisfactory galvanic current and associated corrosion issues in the FSU-1 and FSU-2, both of which are typically made of carbon steel.

The examples show that foulant collecting effectiveness in a PFT fouling environment is increased with increased surface energy and with increased surface area.

What is also evident from the coupons is the friable nature of the foulant, which can easily be removed in situ, for instance, by application of intermittent vibration energy at/or outside the vessels, for instance, during scheduled maintenance.

The use of a foulant collector may be applied to both low- and high-temperature PFT processes, covering a temperature range of, but not restricted to, 15 to 100° C.

While much of the above description refers to reducing build-up and/or carry-over of foulant from a vessel used in a PFT process, reducing build-up and/or carry-over of foulant from a conduit used in a PFT process is also in scope.

In the preceding description, for purposes of explanation, numerous details are set forth in order to provide a thorough understanding of the embodiments of the invention. However, it will be apparent to one skilled in the art that these specific details are not required in order to practice the invention.

While the present invention may be susceptible to various modifications and alternative forms, the exemplary embodiments discussed above have been shown only by way of example. However, it should again be understood that the invention is not intended to be limited to the particular embodiments disclosed herein. Indeed, the present invention includes all alternatives, modifications, and equivalents falling within the true spirit and scope of the appended claims.

We claim:

1. A process for collecting foulant in a vessel or conduit used in a paraffinic froth treatment (PFT) process to reduce build-up or downstream foulant carry-over, the foulant comprising asphaltenes, the process comprising:

disposing a foulant collector comprising a foulant collecting surface in the vessel or conduit to collect foulant as a collected foulant; and removing at least a portion of the collected foulant from the vessel or conduit;

wherein the foulant collecting surface has an average water contact angle of less than 90 degrees, wherein the foulant collecting surface collects the collected foulant preferentially over the vessel or conduit, and wherein the foulant collecting surface comprises a continuous surface having an area equal to or greater than an area of the vessel or conduit which collects the collected foulant in an absence of the foulant collector.

2. The process according to claim 1, wherein the the continuous surface has an area at least 30 percent greater than the area of the vessel or conduit which collects the collected foulant in the absence of the foulant collector.

3. The process according to claim 1, wherein the removing step comprises dislodging at least a portion of the collected foulant from the foulant collecting surface as removed foulant and then removing at least a portion of the removed foulant from the vessel or conduit.

4. The process according to claim 3, wherein the removing step comprises intermittently dislodging at least a portion of the collected foulant from the foulant collecting surface in situ and then removing at least a portion of the removed foulant from the vessel or conduit.

5. The process according to claim 3, wherein the dislodging step comprises scraping the collected foulant from the foulant collecting surface.

6. The process according to claim 3, wherein the dislodging step comprises applying a mechanical force to the foulant collector.

7. The process according to claim 6, wherein the mechanical force comprises applying an impact force to the foulant collector or vibrating the foulant collector.

8. The process according to claim 7, wherein the vibrating is effected using a vibration system external to the vessel or conduit.

9. The process according to claim 8, wherein the vibration system comprises one or more vibrators, the vibrators being pneumatic, electro-magnetic dynamic, or electro-piezo shakers.

10. The process according to claim 7, wherein vibration generated by the vibration system on the surface of the foulant collector has an amplitude of 1 g or higher and an impact frequency of 1 Hz or higher.

11. The process according to claim 7, wherein the vibration is actuated by a vibration actuator that emits sound waves to the foulant collector.

12. The process according to claim 7, wherein the vibration is effected at predetermined intervals of time, or upon command.

13. The process according to claim 1, wherein the removing step comprises removing the foulant collector from the vessel or conduit and then optionally dislodging at least a portion of the collected foulant from the foulant collecting surface.

14. The process according to claim 1, wherein the vessel or conduit is a froth separation unit (FSU), wherein the foulant collector is in a hydrocarbon leg of the FSU, the process further comprising:

prior to the step of removing at least a portion of the collected foulant from the FSU, lowering the foulant collector into a water leg of the FSU;

wherein the step of removing at least a portion of the collected foulant from the FSU comprises removing the at least a portion of the collected foulant together with tailings from the FSU.

15. The process according to claim 1, wherein the foulant collecting surface has impurities having an average water contact angle of greater than 90 degrees in an amount greater than 1000 ppmw.

16. The process according to claim 1, wherein the foulant collecting surface has a standard deviation of water contact angles divided by an average water contact angle of greater than 0.1.

17. The process according to claim 1, wherein the foulant collecting surface comprises carbon steel.

18. The process according to claim 1, wherein the foulant collecting surface is carbon steel.

19. The process according to claim 1, wherein the foulant collecting surface comprises a metal, a ceramic, a polymer, or a composite.

20. The process according to claim 1 further comprising reducing foulant with a fluorocarbon polymer as a surface of the vessel or conduit, wherein the collected foulant comprises asphaltenes, wherein the fluorocarbon polymer surface has: an average water contact angle of greater than 90 degrees; a standard deviation of water contact angles divided by the average water contact angle of less than 0.1; and impurities of less than 1000 ppmw.

21. The process according to claim 20, wherein the average water contact angle of the fluorocarbon polymer surface is greater than 110 degrees; the standard deviation of water contact angles of the fluorocarbon polymer surface divided by the average water contact angle of the fluorocarbon polymer surface is less than 0.05; less than 100 ppmw impurities are present in the fluorocarbon polymer surface; and wherein the fluorocarbon polymer comprises a polytetrafluoroethylene (PTFE)-based polymer, wherein a PTFE-based polymer is a homopolymer of TFE (tetrafluoroethylene) or a copolymer of TFE with one or more comonomers comprising at least one ethylene-type unsaturation, wherein comonomer content is less than 1 percent by weight.

22. The process according to claim 1, wherein the collected foulant comprises 5-80 wt. % water and paraffinic solvent, 1-80 wt. % inorganics, 1-90 wt.% non-volatile hydrocarbons comprising asphaltenes.

23. The process according to claim 22, wherein the inorganics comprise quartz, alumino silicates, carbonates, $Fe_xS_y$, where x is from 1 to 2 and y is from 1 to 3, and titanium-rich minerals.

24. The process according to claim 22, wherein greater than 50% by number of the inorganics are present in particulates of less than 1 μm in size.

25. The process according to claim 1, wherein the collected foulant comprises about 46-50 wt. % water and paraffinic solvent, about 24-46 wt. % inorganics, and about 14-26 wt.% non-volatile hydrocarbons comprising asphaltenes.

26. The process according to claim 1, wherein the collected foulant comprises between 7 and 40 wt. % asphaltenes.

27. The process according to claim 1, wherein the PFT process is a low- or high-temperature process, characterized by a temperature of 15 to 100° C.

28. The process according to claim 1, further comprising applying an impact force to the vessel or conduit or vibrating the vessel or conduit to dislodge the collected foulant from a surface of the vessel or conduit.

29. A process for collecting foulant in a vessel or conduit used in a paraffinic froth treatment (PFT) process to reduce build-up or downstream foulant carry-over, the foulant comprising asphaltenes, the process comprising:

disposing a foulant collector comprising a foulant collecting surface in the vessel or conduit to collect foulant as a collected foulant; and removing at least a portion of the collected foulant from the vessel or conduit;

wherein the foulant collecting surface has an average water contact angle of less than 90 degrees, wherein the foulant collecting surface collects the collected foulant preferentially over the vessel or conduit, and wherein the foulant collecting surface comprises cement, rubber, fibre reinforced plastic, carbon steel or diamond-like carbon.

* * * * *